US007997634B2

(12) United States Patent
Piispanen et al.

(10) Patent No.: US 7,997,634 B2
(45) Date of Patent: Aug. 16, 2011

(54) LIFTING HOOK

(75) Inventors: Hannu Piispanen, Hyvinkää (FI); Ari Lehtinen, Hyvinkää (FI); Jarmo Nikkola, Loppi (FI); Kimmo Hytönen, Hyvinkää (FI)

(73) Assignee: Konecranes PLC, Hyvinkaa (FI)

( * ) Notice: Subject to any disclaimer, the term of this patent is extended or adjusted under 35 U.S.C. 154(b) by 0 days.

(21) Appl. No.: 12/668,332

(22) PCT Filed: Jul. 7, 2008

(86) PCT No.: PCT/FI2008/050416

§ 371 (c)(1), (2), (4) Date: Jan. 8, 2010

(87) PCT Pub. No.: WO2009/007507

PCT Pub. Date: Jan. 15, 2009

(65) Prior Publication Data

US 2010/0187844 A1 Jul. 29, 2010

(30) Foreign Application Priority Data

Jul. 9, 2007 (FI) ..... 20075529

(51) Int. Cl.
*B66C 1/10* (2006.01)

(52) U.S. Cl. ..... 294/81.56; 294/82.19

(58) Field of Classification Search ..... 294/81.56, 294/17, 82.1, 81.1, 81.5, 74, 82.13, 82.19, 294/82.2, 82.21, 68.27

See application file for complete search history.

(56) References Cited

U.S. PATENT DOCUMENTS

| | | | | |
|---|---|---|---|---|
| 1,794,694 | A | 3/1931 | Jensen et al. | |
| 2,577,790 | A | 12/1951 | McCormick | |
| 4,256,336 | A | 3/1981 | Halvorsen | |
| 4,358,146 | A * | 11/1982 | Goudey | 294/82.33 |
| 5,114,200 | A | 5/1992 | Visnyouszky et al. | |
| 5,564,765 | A * | 10/1996 | Schuerch et al. | 294/81.56 |
| 7,093,729 | B2 * | 8/2006 | Monteil et al. | 212/178 |
| 7,399,019 | B2 * | 7/2008 | Malmgren et al. | 294/81.51 |

FOREIGN PATENT DOCUMENTS

| | | | |
|---|---|---|---|
| DE | 19633668 | C1 | 11/1997 |
| FR | 2681057 | A1 | 3/1993 |
| JP | 54-136263 | U | 9/1979 |
| JP | 2001-354388 | A | 12/2001 |

* cited by examiner

*Primary Examiner* — Isam Alsomiri

*Assistant Examiner* — Gabriela Puig

(74) *Attorney, Agent, or Firm* — Birch, Stewart, Kolasch & Birch, LLP

(57) ABSTRACT

A lifting hook is arranged to grab an object to be lifted by a cylindrical lifting surface formed thereto, the lifting hook having a hook shank, a hook part joining the hook shank and a locking device arranged to lock the lifting hook to the object to be lifted. To allow the lifting hook to be reliably attached to the piece to be lifted, a mechanical control device is mounted above the hook part to co-operate with the upper surface of the lifting surface for guiding the hook part to a lifting position onto the lower surface of the lifting surface.

20 Claims, 2 Drawing Sheets

LIFTING HOOK

BACKGROUND OF THE INVENTION

The invention relates to a lifting hook arranged to grab an object to be lifted by a cylindrical lifting surface formed thereto, the lifting hook having a hook shank, a hook part joining the hook shank and a locking device arranged to lock the lifting hook to the object to be lifted, a mechanical control device being mounted above the hook part to co-operate with the upper surface of the lifting surface for guiding the hook part to a lifting position onto the lower surface of the lifting surface. The invention particularly relates to a hook meant for handling jumbo paper rolls in a paper mill, in which case two hooks are usually provided. The hooks are attached to the ends of a load-carrying beam designed for handling paper rolls and configured to engage with cylindrical lifting surfaces of cylindrical reeling shafts of the paper rolls. The hook is also suitable for handling other objects provided with a cylindrical lifting surface.

Prior art lifting hooks have been disclosed for example in publications U.S. Pat. No. 2,577,790 A, U.S. Pat. No. 5,114,200 A and JP 2001354388.

The lifting hooks of a load-carrying beam of a crane used in a paper mill for lifting and moving a paper roll are first guided to cylindrical lifting surface grooves formed to the ends of the reeling shafts of the paper roll, then the hooks are guided into the grooves, making sure that they engage with the lifting surface grooves of the shafts from below, the hooks being then locked to the lifting surface grooves and hence the paper roll may be lifted and transferred. This may take place either automatically or by manual control.

A problem with the paper roll handling described above is that particularly in connection with an automated lifting control, the lifting hook does not engage properly with the lifting surface groove, the hook drifts outside the groove or an erroneous hook locking confirmation is received even if locking of the hook to the proper locking point had not taken place. If the paper roll or one of its ends then comes off from one or both of the hooks in connection with the lifting, serious damage may be caused. Typically, if a roll falls onto its support stand from a height more than 10 cm, for example, the expensive reeling shaft of the paper roll will become twisted and unusable. On the other hand, if the roll falls onto the floor of the paper mill, the entire floor structure may suffer significant damages on a large area.

Automated lifting control has typically been carried out using information provided by location sensors mounted to the lifting hook and possibly to the reeling shaft of the paper roll as well, which has not been completely reliable in all situations. It has therefore usually been necessary to ensure the fastening manually or visually, which in practice often means that the crane operator walks to the spot and confirms the situation.

In connection with manual lifting control the crane operator usually fastens and locks the lifting hooks to the paper roll by hand, which always requires walking back and forth between the crane and the paper rolls.

It is clear from the above that without reliable lifting hook control, fastening and locking paper rolls may be expected to fall off and to cause considerable costs due to damages. If this risk is to be avoided, as it nowadays always is, the handling of paper rolls will suffer from unnecessary delays because of the obligatory manual and visual control checks made on foot.

SUMMARY OF THE INVENTION

It is therefore an object of the present invention to overcome the above problems. A particular object is to provide a solution allowing fully automated lifting and transfer movements of paper rolls to be provided without any risks.

These objects are achieved by a solution of the invention, which is characterized in that the lifting surface is a grooved surface and in that the control device is a protrusion which is narrower than the lifting surface and extends forwardly from the hook shank in line with the lateral direction of the hook part, the forward end of the protrusion being provided with a control arm having a lower surface upwardly inclined towards the upper surface of the protrusion and side surfaces tapering towards the tip of the protrusion.

In other words, the invention is based on a mechanical control device driven by contact with the side of object to be grabbed that faces away from its lifting point.

The control power of the control device that guides the lifting hook to its position is produced by means of the driving movement of the crane, taking advantage of the shape of the mechanical control device to be described below, for simultaneously deviating the hook from its position of balance for guiding it to a lifting contact with the lifting surface.

The invention offers obvious advantages in that it provides an absolutely reliable lifting event also in connection with a fully automated lifting operation and, since control checks by human intervention no longer take place, speeds up significantly lifting events both in connection with manual and automated lifting.

LIST OF FIGURES

In the following the invention will be disclosed in greater detail in connection with preferred embodiments and with reference to the accompanying drawings, in which FIG. 1 is a front view of a load-carrying beam of a crane with lifting hooks of the invention fastened to the ends thereof;

DETAILED DISCLOSURE OF THE INVENTION

Figure 1:
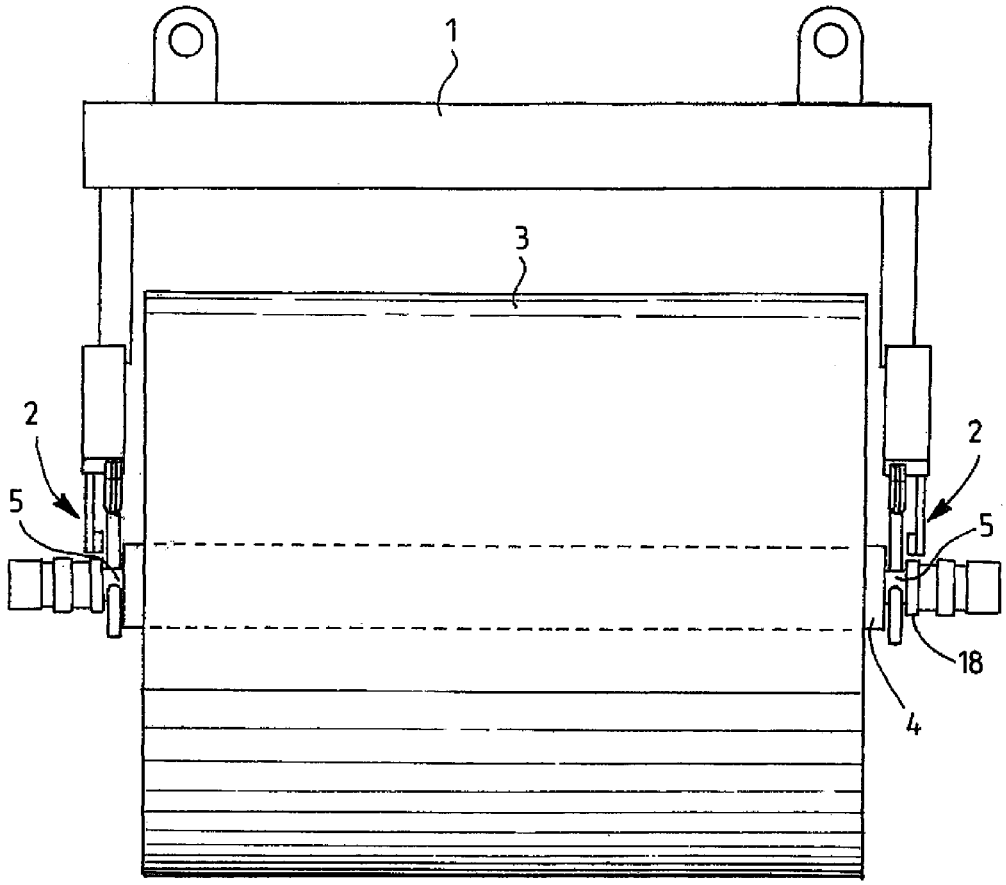

With reference FIG. 1, a load beam 1 of a crane bridge is shown, the ends of the beam being provided with lifting hooks 2 of the invention. The lifting hooks 2, in turn, are shown engaged with cylindrical lifting surface grooves 5 provided on a reeling shaft 4 of a jumbo paper roll 3 of a paper mill, the grooves having a diameter which is smaller than adjacent surface portions of the reeling shaft 4.

Figure 2:
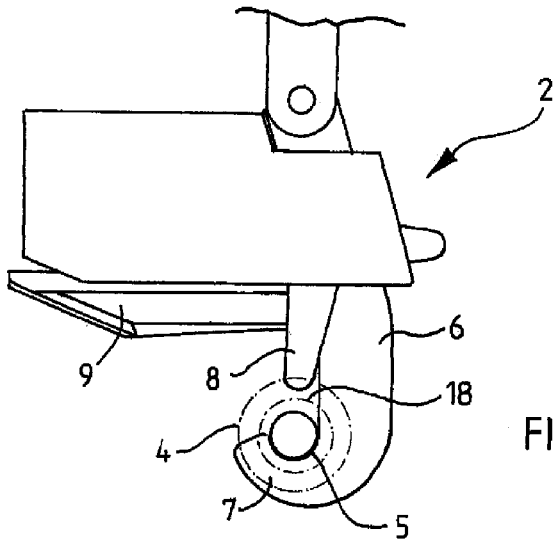
FIG. 2 is a side view of one of the hooks of FIG. 1.
Figure 3:
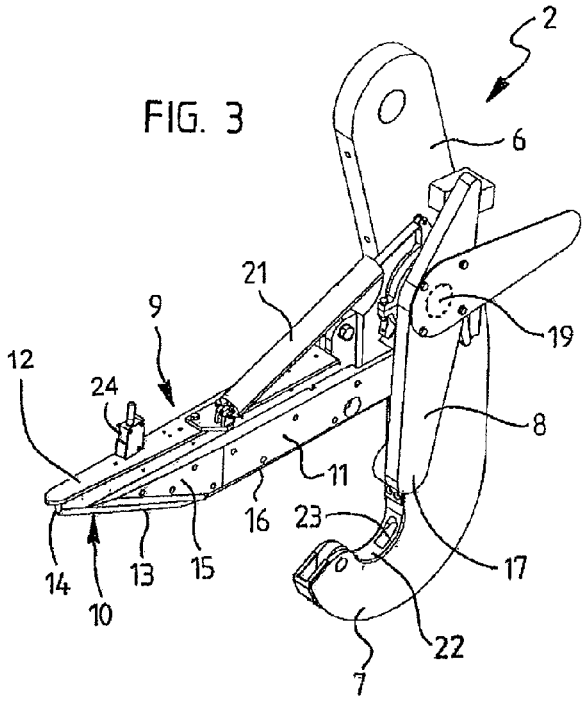
FIG. 3 shows a perspective view of the lifting hook of the preceding figures with the protective casing of the control device and the locking device removed.

FIGS. 2 and 3 show a more detailed view of the lifting hook 2, which comprises a hook shank 6, a hook part 7 joining the hook shank 6, a locking device 8 arranged to lock the lifting hook to the object to be lifted, i.e. to the roll 3 in this case, a mechanical control device 9 mounted above the hook part 7 and arranged to co-operate with the upper surface of the lifting surface groove 5 for guiding the hook part 7 to a lifting position onto the lower surface of the lifting surface groove.

The control device 9 is a protrusion 9 which is narrower than the lifting surface groove 5 and extends forwardly from the hook shank 6 in line with the lateral direction of the hook part 7, the forward end of the protrusion 9 being provided with a control arm 10 having a lower surface 13 upwardly inclined towards the upper surface 12 of the protrusion 9 and side surfaces 15 tapering towards the tip 14 of the protrusion 9, while the lower surface 16 of a protrusion arm 11 extending from the hook shank 6 towards the control arm 10 of the protrusion is, in turn, slightly downward inclined, this inclination being smaller than the upward inclination of the lower surface 13 of the control arm 10 of the protrusion.

The locking device 8 is a forced lever 8 mounted on bearings to the hook shank 6 or the control device 9, the tip 17 of the lever being outside the lifting groove surface 5 of the object to be lifted 3 in the lateral direction of the hook part 7 and co-operating with a cylindrical locking surface 18 adjacent to the lifting surface groove 5, the locking surface diameter being greater than that of the lifting surface groove 5. When the object to be lifted 3, or, as specifically in this case, the lifting surface groove 5 of the reeling shaft 4 is being guided to the hook part 7, the lever 8 is arranged to pivot guided by the upper surface of the lifting surface groove 5 and to allow the lifting surface groove 5 to set into the hook part 7, whereas when the lifting surface groove 5, i.e. the object to be lifted 3, is in the hook part 7, the lever 8 thus being in an unloaded state, the tip 17 of the lever 8 is forced to protrude past the centre point of the cylindrical locking surface 18 in the forward extending direction of the hook part 7 for locking the object to be lifted 3 to the hook part 7. The forced action of the locking lever 8 may be implemented by means of a spring (not shown), which may be arranged onto a shaft 19, for example, that attaches the lever 8 in a pivoting manner to the hook shank 6. The locking lever 8 may be further provided with an actuator 21 for pivoting it towards the hook shank 6 for removing the object to be lifted 3 from the hook part. The actuator 21 may be electrical or hydraulic, for example, or a combination of these.

The gripping surface 22 (i.e. the surface that comes into contact with the lower surface of the control surface groove 5) of the hook part 7 and the control device 9 may be provided with an electrical positioning sensor arrangement 23, 24 for ensuring the control and attachment of the hook part 7. The sensor arrangement 24 of the control device 9 informs the direction towards the lifting surface groove 5 by "looking" through the groove 5, the sensor arrangement 23 of the hook part 7 informing when the lower surface of the lifting surface groove 5 is in the hook part 7 to a sufficient extent.

Figure 4A:
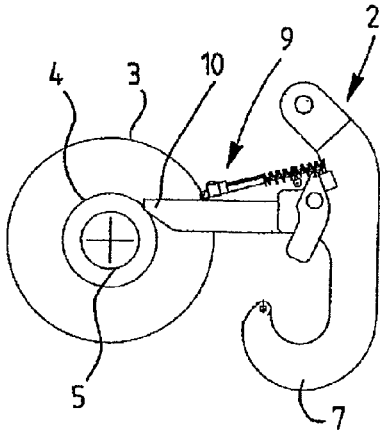
FIGS. 4A to 4C illustrate step by step the operation of the lifting hook of the invention.
Figure 4B:
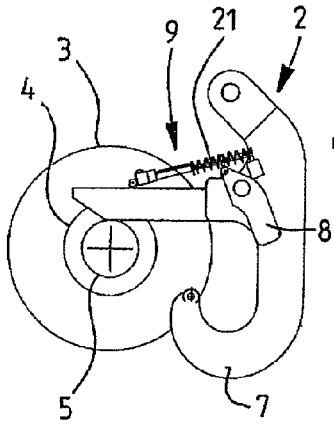
Figure 4C:
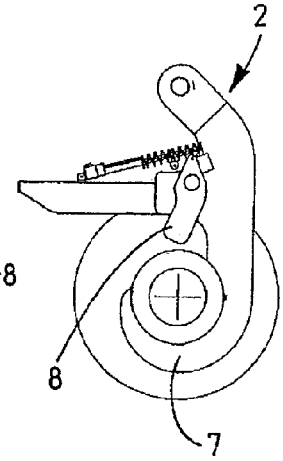

FIGS. 4A to 4C show step by step how the lifting hook 2, i.e. its hook part 7, proceeds into the lifting surface groove 5 of the object to be lifted 3. In FIG. 4A the lifting hook 2 is driven towards the lifting point of the object to be lifted 3, i.e. the lifting surface groove 5 of the reeling shaft 4, in a horizontal direction until the control arm 10 of the control device 9 meets the groove 5. The control device 9 then deviates the hook 2 from its position of balance and guides the hook part 7 to the lower surface of the lifting surface groove 5 while the control device 9 slides on the upper surface of the lifting surface groove 5, as shown in FIG. 4B. FIG. 4B shows the locking device 8 pushed into a release state by the actuator 21, although in practice it is guided by the locking surface 18 of the reeling shaft 4. FIG. 4C shows the control device 9 released from the guidance of the lifting surface groove 5 when the lifting hook 2 is being lifted. The lower surface of the lifting surface groove 5, and thereby the object to be lifted, is in the hook part 7 of the hook 2. At the same time the locking device 8 has pivoted automatically or has been pivoted to the locking position.

The above specification is only meant to illustrate the basic idea of the invention. A person skilled in the art may therefore modify its details within the scope of the accompanying claims.

The invention claimed is:

1. A lifting hook arranged to grab an object to be lifted by a cylindrical lifting surface formed thereto, the lifting hook having a hook shank, a hook part joining the hook shank and a locking device arranged to lock the lifting hook to the object to be lifted, a mechanical control device being mounted above the hook part to co-operate with the upper surface of the lifting surface for guiding the hook part to a lifting position onto the lower surface of the lifting surface, wherein the lifting surface is a grooved surface and in that the control device is a protrusion which is narrower than the lifting surface and extends forwardly from the hook shank in line with the lateral direction of the hook part, the forward end of the protrusion being provided with a control arm having a lower surface upwardly inclined towards the upper surface of the protrusion and side surfaces tapering towards the tip of the protrusion.

2. A lifting hook according to claim 1, wherein the lower surface of a protrusion arm extending from the hook shank towards the control arm of the protrusion is slightly downward inclined, this inclination being smaller than the upward inclination of the lower surface of the control arm of the protrusion.

3. A lifting hook according to claim 2, wherein the locking device is a forced lever mounted on bearings to the hook shank or the control device, the tip of the lever being outside the lifting surface of the object to be lifted in the lateral direction of the hook part and co-operating with a cylindrical locking surface adjacent to the lifting surface, the locking surface diameter being greater than that of the lifting surface, and when the object to be lifted is guided to the hook part, the lever is arranged to pivot by this guiding action and to allow the lifting surface of the object to be lifted to set into the hook part, whereas when the object to be lifted is in the hook part, the lever thus being in an unloaded state, the tip of the lever is forced to protrude past the centre point of the cylindrical locking surface in the forward extending direction of the hook part for locking the object to be lifted to the hook.

4. A lifting hook according to claim 3, wherein the forced action of the locking lever is produced by a spring.

5. A lifting hook according to claim 4, wherein the forced action of the control device is produced by means of a counterweight.

6. A lifting hook according to claim 4, wherein the locking lever is provided with an actuator for pivoting it towards the hook shank for removing the object to be lifted from the hook part.

7. A lifting hook according to claim 4, wherein the gripping surface of the hook part and the control device are provided with an electrical sensor arrangement for ensuring the control and the attachment of the hook.

8. A lifting hook according to claim 4, wherein two hooks are provided and they are attached to the ends of the load-carrying beam meant for the handling of paper rolls in a paper mill, the hooks being configured to grab the paper rolls by the cylindrical lifting surfaces of the cylindrical reeling shafts.

9. A lifting hook according to claim 3, wherein the locking lever is provided with an actuator for pivoting it towards the hook shank for removing the object to be lifted from the hook part.

10. A lifting hook according to claim 9, wherein the gripping surface of the hook part and the control device are provided with an electrical sensor arrangement for ensuring the control and the attachment of the hook.

11. A lifting hook according to claim 3, wherein the forced action of the control device is produced by means of a counterweight.

12. A lifting hook according to claim 3, wherein the gripping surface of the hook part and the control device are provided with an electrical sensor arrangement for ensuring the control and the attachment of the hook.

13. A lifting hook according to claim 3, wherein two hooks are provided and they are attached to the ends of the load-carrying beam meant for the handling of paper rolls in a paper mill, the hooks being configured to grab the paper rolls by the cylindrical lifting surfaces of the cylindrical reeling shafts.

14. A lifting hook according to claim 2, wherein the forced action of the control device is produced by means of a counterweight.

15. A lifting hook according to claim 14, wherein the locking lever is provided with an actuator for pivoting it towards the hook shank for removing the object to be lifted from the hook part.

16. A lifting hook according to claim 14, wherein the gripping surface of the hook part and the control device are provided with an electrical sensor arrangement for ensuring the control and the attachment of the hook.

17. A lifting hook according to claim 2, wherein the gripping surface of the hook part and the control device are provided with an electrical sensor arrangement for ensuring the control and the attachment of the hook.

18. A lifting hook according to claim 2, wherein two hooks are provided and they are attached to the ends of the load-carrying beam meant for the handling of paper rolls in a paper mill, the hooks being configured to grab the paper rolls by the cylindrical lifting surfaces of the cylindrical reeling shafts.

19. A lifting hook according to claim 1, wherein the gripping surface of the hook part and the control device are provided with an electrical sensor arrangement for ensuring the control and the attachment of the hook.

20. A lifting hook according to claim 1, wherein two hooks are provided and they are attached to the ends of the load-carrying beam meant for the handling of paper rolls in a paper mill, the hooks being configured to grab the paper rolls by the cylindrical lifting surfaces of the cylindrical reeling shafts.

* * * * *